United States Patent [19]

Bonnard et al.

[11] 4,048,888

[45] Sept. 20, 1977

[54] MACHINES FOR CUTTING CARDBOARD AND OTHER ARTICLES

[76] Inventors: Louis Antoine Bonnard, 49, rue Gaspard Picard, Venissieux, France, 69200; Claude Raymond Pierron, 32, avenue Gambetta, St Cyr au Mt d'Or, France, 69450

[21] Appl. No.: 726,333

[22] Filed: Sept. 24, 1976

[30] Foreign Application Priority Data

Oct. 22, 1975 France ..... 75.32985

[51] Int. Cl.[2] ..... B26D 7/06

[52] U.S. Cl. ..... 83/89; 83/94; 83/100; 83/142; 83/161; 83/168

[58] Field of Search ..... 83/89, 94, 100, 142, 83/161, 168

[56] References Cited

U.S. PATENT DOCUMENTS

| | | | |
|---|---|---|---|
| 2,185,094 | 12/1939 | Randall | 83/142 |
| 2,307,594 | 1/1943 | Lee | 83/89 |
| 3,830,121 | 8/1974 | Makeev et al. | 83/94 X |

*Primary Examiner*—Willie G. Abercrombie
*Attorney, Agent, or Firm*—Dowell & Dowell

[57] ABSTRACT

A machine for cutting cardboard and similar articles comprises a stationary platen mounted on the machine frame and an oscillating movable platen pivoted thereon to receive sheets one at a time from a magazine, means for delivering the sheets from the magazine to the moving platen, means for giving an oscillating movement to the moving platen and pivoting it, into contact with its stationary platen, blades for cutting the sheet on the moving platen and suction means on a pivoted chassis for removing the cut sheets and transferring them to a horizontal delivery conveyor and a rotary brush for wiping the surface of the moving platen.

8 Claims, 5 Drawing Figures

MACHINES FOR CUTTING CARDBOARD AND OTHER ARTICLES

This invention relates to improvements in machines for cutting cardboard or other articles.

Machines have been known for many years in the cardboard making industry for the cutting of sheets of cardboard, comprising a substantially vertical fixed platen forming a support for a cutting form provided with knives and a movable platen operated by an oscillating movement for bringing into contact with the sheet, the sheets being successively brought into contact with its inner face. These machines are particularly simple and robust and give a completely satisfactory operation but they however cause a considerable amount of work. The placing of the sheets against the movable plate is effected mannually in the same way as their withdrawal after cutting, cutting is carried out incompletely so that the operation may extract the whole of the sheet by resiliently deformable push-rods, the stripping, that is to say, the separation of the two cut parts (outer part and inner part in respect of the profile of the knives) being carrier out either manually or mechanically in the course of a subsequent operation.

The improvements forming the subject of the present invention have the object of providing the conventional machines of the aforementioned type with a system of stripping adapted to allow the separation of the two parts of the cut articles as well as their selective removal.

According to the invention the cutting member is arranged so that it comprises push rods resiliently deformable in respect to one of the two parts obtained after the cutting of each article the part thus ejected falling by gravity onto an evacuation device placed under a fixed platen whilst the other part still adhering to the knives or blades of the aforementioned form is gripped by removal means associated with a movable chassis which directs the said part onto a second evacuation device provided in the upper part of the machine.

The stripping of each article after cutting and the selection of the two parts obtained are thus effected in an entirely automatic manner. With a view to further improving the automatic working of the machine it is arranged for the latter to have a feed device obviating any mannual intervention the said device comprising two drivers disposed below a distribution feeder of known type.

The invention will be described with reference to the accompanying drawings, given by way of example.

Figure 1:
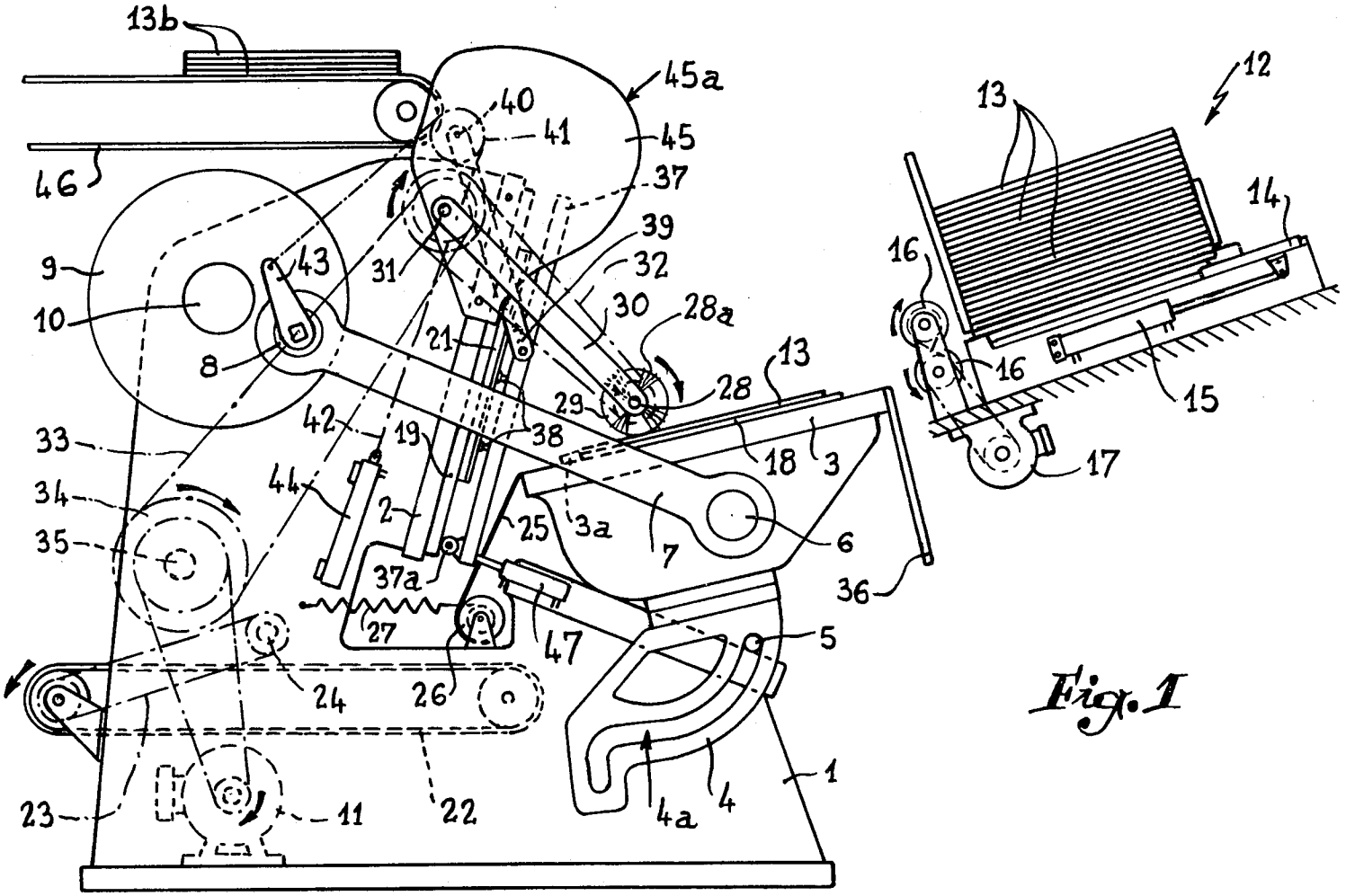
FIG. 1 is a side view showing diagrammatically the general arrangement of a machine.

The machine shown in FIG. 1 is of the type referred to above and comprises a frame 1 forming a support for a fixed platen 2 arranged substantially vertical. With this fixed platen 2 is associated a movable platen 3 and the rear part of which is integral with a guide 4 having a slot **4*a* on the inside of which is arranged a fixed pin 5 carried by the frame 1. On the movable platen 3 are provided two studs 6 on each of which is pivoted a rod 7 the free end of which is attached to a stud 8 eccentrically mounted on a corresponding disc 9.** The two discs

9 are keyed on the same horizontal shaft 10 connected through a suitable gearing to a driving motor 11. The continuous rotation of this shaft 10 causes through the two rods 7 an oscillating movement of the movable platen 3 which is thus compelled with the co-operation of the guide 4 and of the pin 5 to approach the fixed platen 2 and then to move away therefrom; the two extreme positions are illustrated respectively on FIGS. 2 and 1.

With the machine or press thus arranged is firstly associated an automatically operating feed drive adapted to carry the articles to be cut, which are constituted by sheets of cardboard, against the inner face of the movable platen 3 whilst the latter is in the open position of FIG. 1. This device comprises a feed device 12 of known type supporting a stack of sheets 13 which a lower push rod 14 controlled by a double action cylinder 15 removes on by one at a rate which is a function of the rate of working of the machine itself. Each sheet 13 thus removed is introduced between two discs 16 driven in opposite direction to one another by a motor shown diagrammatically at 17; the disc 18 causing the sheet 13 to contact the inner face of the movable platen 3, which is provided with a member 18.

In known manner the fixed plate 2 is provided with a cutting member 19 on its face remote from the member 18 of the movable platen 3; the member 19 forming a support for the cutting knives or blades 20 the oblique cutting edges to which are inclined outwards. This member 19 carries in known manner a series of resilient push rods 21, it being noted however that these latter are all mounted outside the envelope determined by the blades 20.

In the lower part of the frame 1 there is arranged delivery 22 of the endless belt type (FIG. 1) which a belt 23 connects to a intermediate shaft 24 of the machine, the said shaft 24 being continuously driven by the motor 11. Above this conveyor 22 there is provided a screen mechanism comprising a clot 25 one transverse edge of which is fixed to the lower edge of the movable platen 3 whilst the opposite edge is rendered integral with a winding drum 28 associated with a resilient return system, shown diagrammatically in the form of a spring 27. The cloth 25 thus follows the oscillating movement of the movable platen and forms a guide for the cardboard parts or pieces separated from the fixed platen as hereinafter described.

With the movable platen 3 there is also associated a brushing system comprising a horizontal shaft 20 along which are fixed four sets of brush tufts **28*a* arranged at 90° relatively to one another. The ends of this shaft 28 provided with supporting rollers 29 are rotated by two parallel arms 30 hinged on an upper spindle 31. The rotary drive of the brush 28–28*a* is ensured by a belt 32 arranged parallel with the arms 30, this belt 32 itself being connected by a belt 33 to a chain wheel or pulley 34 keyed on an intermediate shaft 35 of the driving system associated with the discs 9. At the time of the oscillation of the movable platen 3 the rollers 29 roll against the inner face of the latter and against an end plate 36 integral with this latter so that the brushes 28*a*** sweeps the aforementioned inner face.

The machine is provided with a movable chassis 37 provided on one of its faces with a series of suckers 38 connected by flexible members, not shown, to a source of pressure located in the frame 1. These suckers 38 are disposed on the chassis 37 opposite the surface defined on the cutting members 19 inside the blades 20.

Figure 2:
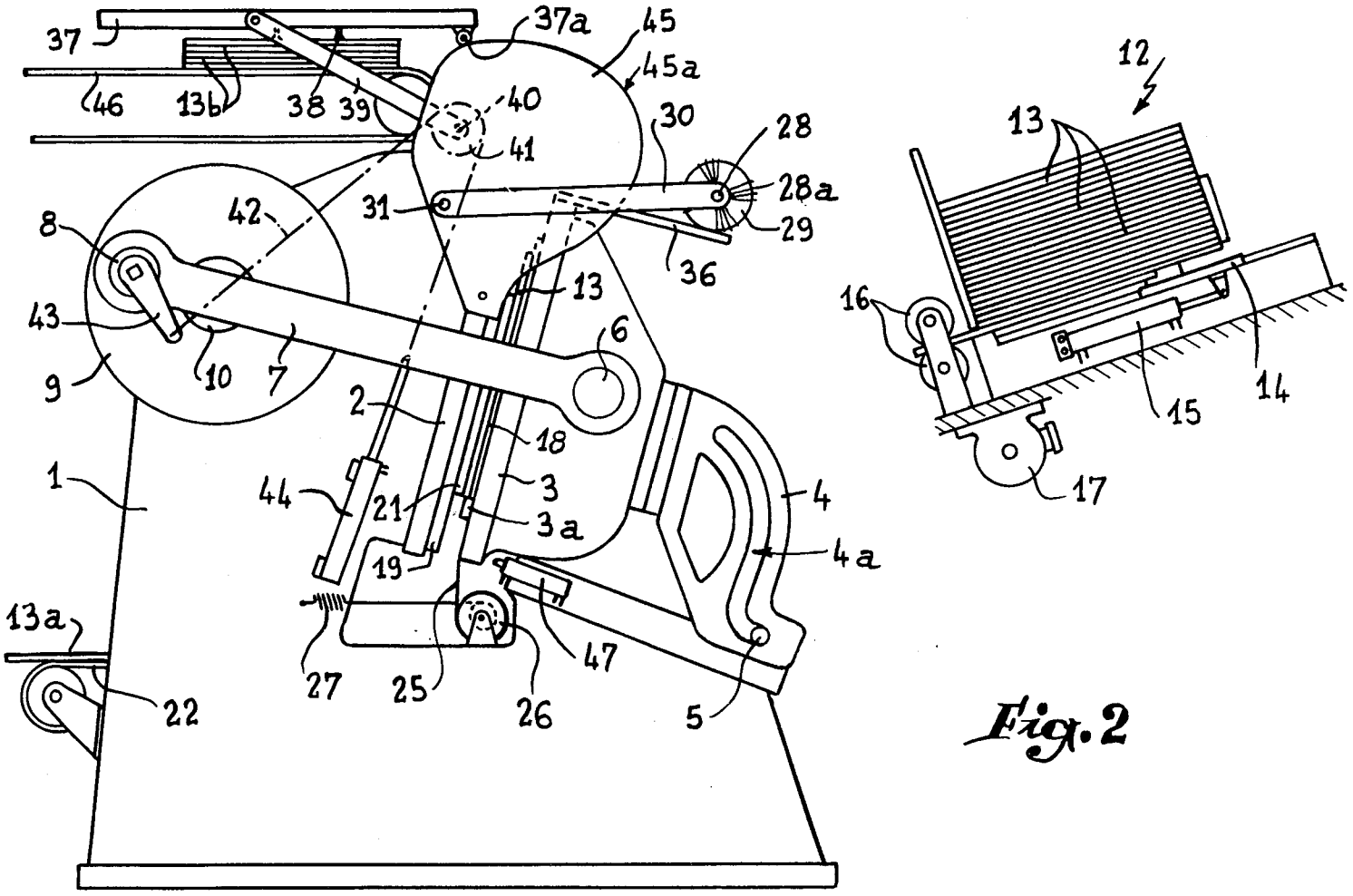
FIG. 2 is a similar view to FIG. 1 after the rocking of the movable platen.

As more particularly shown in FIG. 2 the chassis 37 is carried by two parallel arms 39 adapted to act as tie-rods the ends of which are hinged on the said chassis 37 and mounted on a transverse shaft 40 integral with the frame 1. On this shaft 40 are keyed two chain wheels 41 which a chain 42 connects to a corresponding crank 43 keyed to the end of the spindle 8 on which is hinged the rod 7. The opposite end of the chain 42 is attached to the movable member of a cylinder 44.

One of the sides of the chassis 37 is provided with two rollers 37*a* which roll on the profile 45*a* of two fixed lateral camtracks 45 and although the rotation of the wheel 41 under the action of the crank 43 causes the alternate displacement of the said chassis 37 from an upper position (FIG. 2) in which it is arranged above an endless belt 46 to a lower position (FIG. 1) in which it faces the cutting member 19, the movable platen 3 being brought into the upper position. It will be noted that in this last position the movable member of the two small lateral cylinders 47 engages against the chassis 37 (FIG. 1).

The working of the abovedescribed machine follows from the foregoing and is easily understood.

Figure 4:
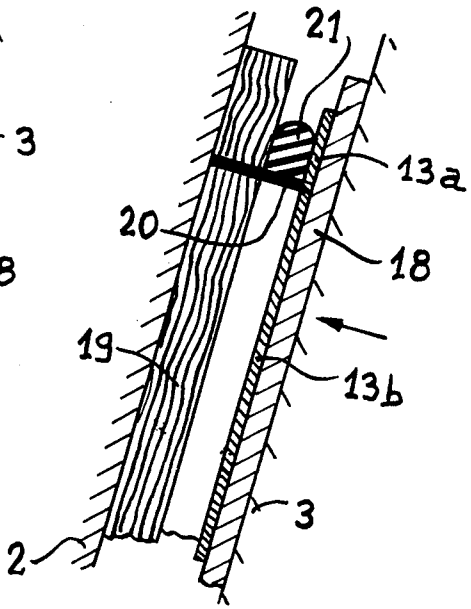
Figure 3:
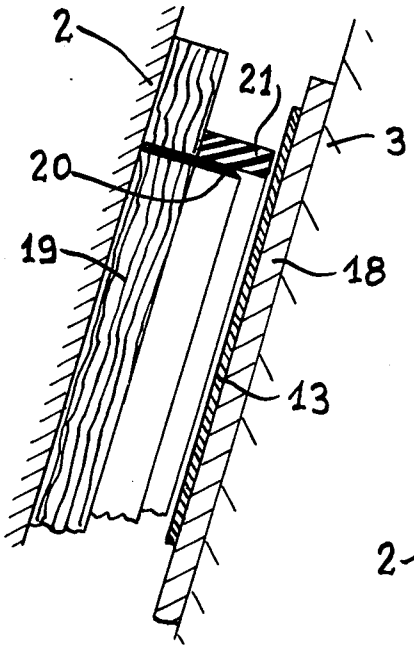

In FIG. 1 the feeding device 12 and the member 18 transfer a sheet of cardboard to be cut onto the movable platen 3. The rods 7 start the movement of the movable platen 3 although the brush 28*a* is operated to sweep the inner face of the platen ensuring the correct positioning of the sheet 13 against the stops 3*a;* at the same time the arms 39 pivot, causing the raising of the movable chassis 37 which finally is located in the upper position shown in FIG. 2. The movable platen 3 thus approaches the fixed platen 2 (FIG. 3) and applies the sheet 13 first of all against the push rods 21 which are then compressed (FIG. 4) then against the cutting edge of the blades 20 which therefore pass through the thickness of the said sheet 13 which is completely cut.

Figure 5:
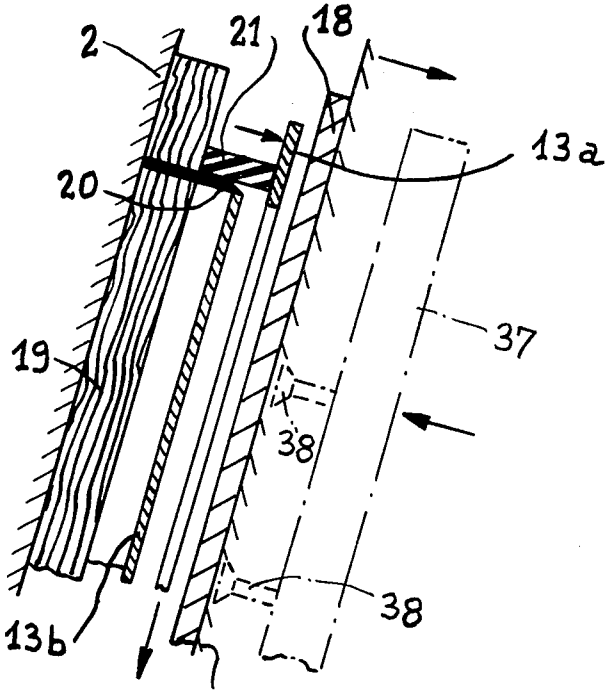
FIGS. 3–5 are vertical sections to a larger scale illustrating the stripping of an article and the selection of the two parts obtained after cutting off the latter.

The movable platen 3 now commences its opening movement (FIG. 5) so that the push rods 21 again assume this normal profile and eject the severed outer part 13*a* of the sheet; this part 13*a* falls by gravity, guided by the screen 25 onto a conveyor 22 and is removed by this latter, whilst the inner part 13*b* of the cut sheet is held by friction and wedging inside the profile of the blades 20 and the movable chassis 37 which causes its removal. In fact in the course of the progressive opening of the platen 3 the control cylinder 44 is operated to cause contraction, although the rollers 37*a* roll first of all over the profile 45*a* of the cams 45 then agains the vertical edges of the member 19 until returning to lower position shown in FIG. 1, the cylinders 47 are in their turn operated to extend their movable members which push back in aforementioned chassis 37 against the fixed platen 2 which has the effect of applying the suckers 38 against the centre of the part 13*b.* The valve interposed between the suckers 38 and the source of pressure is controlled at the opening and the suction exercised by these suckers 38 effects the drawing away of the part 13*b.*

During the course of the opening of the platen 3 the brush 28*a* has swept the inner face of this platen removing in this way the cuttings which might possibly remain thereon. The platen 3 then starts its closing course and a new cycle of operation for the cutting of a subsequent sheet 13. The chassis 37 consequently returns to the high position transferring with it the central part 13*b;* the suction effect is cut at the end of the cycle when this part 13*b* is disposed on the conveyor ensuring the progressive formation of a stack which is removed by the said conveyor when the parts 13*b* reach a predetermined number.

The whole of the operation as carried out effected completely automatically without necessitating any mannual intervention and it will be noted that by means of a suitable arrangement of the feed device associated with the machine, this latter is suitable for cutting not only separate sheets as hereinbefore described but also a continuous article in band form. The return movement of the movable chassis 37 from the high position to the low position is capable of being utilized for putting in place the cutting member against the fixed plate 2, the movement of this chassis in the opposite direction ensuring in the same way the withdrawal of the said member.

It is obvious that the arrangement of the elastic push rods 21 may be reversed, that is to say, mounted inside the profile determined by the blades 20 the cutting edge of the latter being correctly directed to retain by wedging the outer part 13*a.*

It must moreover be understood that the preceeding description has only been given by way of example and that does not limit in any way the scope of the invention from which no departure will be made by replacing the details of carrying it out described by any other equivalents in particular as regards the means provided on the chassis 37 for the removal of the cut part which is retained by the blades, the embodiment of the removal devices 22 and 46, the type of distributor 12 (removed of the sheets from the top or from the bottom), etc; In Certain cases there may be associated with the push rods pneumatic extractors adapted to push the part 13*a* and to improve the descent of the latter by gravity.

What I claim is:

1. A machine for cutting cardboard and other articles comprising a frame; a platen affixed to the frame substantially vertically thereon, a movable platen pivotally mounted on the frame, a horizontal shaft carried by the frame to impart an oscillating movement to the movable platen and rods pivoted on the shaft and to the movable platen, a chassis, parallel arms pivoted on the chassis and a transverse shaft mounted in the frame, a chain and chain wheels mounted on the shaft, a crank on the horizontal shaft to which one end of the chassis is affixed and a cylinder mounted on the frame to which the opposite end of the chain is affixed, a cam track mounted on the frame and rollers carried by the chassis to engage the cam track and a motor for driving the horizontal shaft, rotation of the shaft lifting the movable platen from a sheet receiving position to a delivery position, a pusher rod for feeding the sheets onto the movable platen, a centering member and blades thereon which cut the sheet on the movable platen, suction members for securing one portion of the sheet on the movable platen whilst the other portion falls away by gravity, means for releasing the suction members when the movable platen is in its horizontal position and a conveyor for removal of the portions released from the movable platen.

2. A machine for cutting cardboard and other articles as in claim 1 in combination with arms pivoted on the frame and a rotary brush mounted thereon to wipe the surface of the platen to remove dust after the cutting operation.

3. A machine for cutting cardboard and other articles as in claim 1 in combination with a slotted guide carried by the movable platen and a pin on the frame engaging the slot to limit the movement of the movable platen in both directions.

4. The machine for cutting cardboard and other articles as in claim 1 in which a feed device automatically feeds the sheets onto the movable platen.

5. A machine for cutting cardboard and other articles as in claim 1 comprising two rods on which the movable platen is mounted and means for angularly controlling the rods to ensure the movement of the chassis as the rollers travel over the cam track.

6. A machine for cutting cardboard and other articles as in claim 1 in which the suction members are operated pneumatically.

7. A machine for cutting cardboard and other articles as in claim 1 in which a screen is mounted below the fixed platen to guide the waste material as it falls by gravity and a second conveyor to receive the waste material and take it away.

8. A machine for cutting cardboard and other articles as in claim 1 in which means are provided for stacking the sheets released from the movable platen in piles of a predetermined number on the conveyor.

* * * * *